US006977029B2

(12) United States Patent
Takeuchi et al.

(10) Patent No.: US 6,977,029 B2
(45) **Date of Patent: *Dec. 20, 2005**

(54) DOCTOR BLADE

(75) Inventors: Tetsuo Takeuchi, Tokyo (JP); Hirofumi Ishii, Tokyo (JP); Mitsuyoshi Matsuno, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 355 days.

This patent is subject to a terminal disclaimer.

(21) Appl. No.: 10/245,112

(22) Filed: Sep. 17, 2002

(65) Prior Publication Data

US 2003/0051847 A1 Mar. 20, 2003

(30) Foreign Application Priority Data

Sep. 19, 2001 (JP) ..... 2001-285017

(51) Int. Cl.[7] ..... D21F 7/06

(52) U.S. Cl. ..... 162/263; 162/281; 162/199; 15/298.1; 15/256.51; 428/114; 399/350; 118/118; 118/413

(58) Field of Search ..... 162/263, 281, 162/199; 15/298.1, 256.51, 256.5, 298.7; 428/114; 399/350; 118/123, 413

(56) References Cited

U.S. PATENT DOCUMENTS 6,643,890 B2 * 11/2003 Carrier ..... 15/256.51

FOREIGN PATENT DOCUMENTS

JP 56-20697 2/1981

* cited by examiner

*Primary Examiner*—Mark Halpern
(74) *Attorney, Agent, or Firm*—Howson and Howson

(57) ABSTRACT

A doctor blade for removing water, which excels in water removal capability and shape retention capacity, and suppresses abrasion of the belt or other mating member with which it cooperates, is a fibrous laminate comprising integrated base material and batt fiber layers. By impregnating resin into one side of the fibrous laminate, a layer in which the amount of impregnated resin is large and a layer in which the amount of impregnated resin is small are provided. In use, the layer in which the amount of resin is small is in contact with a belt or other mating member. The doctor blades can be adapted to the mating member easily, and excel in the water removal capability and shape retention, and suppress abrasion of the mating member.

4 Claims, 4 Drawing Sheets

FIG.4

| Structural part | Item | Comparative example-1 | Comparative example-2 | Example -1 | Example -2 | Example -3 | Conventional example-1 |
|---|---|---|---|---|---|---|---|
| Fiber part | Base material | PET basis weight 100g/m$^2$ | ← | ← | ← | ← | ← |
| | Batt material | PET fiber 17dtex | ← | ← | ← | ← | ← |
| | Batt basis weight | 120g/m$^2$ | ← | ← | ← | ← | ← |
| | Density(g/cm$^3$) | 0.35 | ← | ← | ← | ← | 0.55 |
| | Space occupational rate(%) | 25.4 | ← | ← | ← | ← | 39.9 |
| Resin part | Material | SBR | ← | ← | ← | ← | ← |
| | Density(g/cm$^3$) | 1.0 | ← | ← | ← | ← | ← |
| | Resin impregnation rate(R/F)% | 5 | 20 | 20 | 20 | 20 | 30 |
| | T(mm) | 10 | 10 | 7 | 5 | 3 | 10 |
| | Space occupational rate(%) | 1.8 | 7.00 | 7.00 | 7.00 | 7.00 | 16.50 |
| The whole | Void content(%) | 72.9 | 67.6 | 67.6 | 67.6 | 67.6 | 43.6 |
| Abrasion performance | Compared by ratio | 175 | 160 | 170 | 180 | 190 | 100 |
| Water removing capability | Compared by ratio | 220 | 190 | 215 | 220 | 230 | 100 |
| Shape retention capacity | | △ | ○ | ○ | ○ | ○ | ○ |

DOCTOR BLADE

CROSS REFERENCE TO RELATED APPLICATION

This application claims priority from Japanese patent application 285017, filed Sep. 19, 2001.

FIELD OF THE INVENTION

This invention relates to a doctor blade, and more particularly to a doctor blade suitable for removing water from an elastic belt in the press part of a papermaking machine.

BACKGROUND OF THE INVENTION

FIG. 5 shows a typical shoe press apparatus at the press part N of a papermaking machine. In this shoe press apparatus, a pair of felts F, and an endless elastic belt B, having no air permeability, are pinched between a press roll P and shoe S. When the press roll P rotates in the direction of arrow P', the belt B also rotates in the direction of arrow B'. As a wet paper web W passes through the press part N between the felts F, water is squeezed from the web.

Oil is supplied to the inside of the elastic belt B to reduce friction against the shoe S.

Since the surface of the shoe S is opposed to the outer surface of the press roll P, the area of the press part N is large compared to the area of the press part in an apparatus composed of a pair of press rolls, and a greater water squeezing effect is achieved. Therefore, this shoe press apparatus has the advantage that the energy expended in drying the wet paper web W is significantly reduced.

As shown in FIG. 6, which is an enlarged cross-sectional view showing the structure of an elastic belt B used in the above-described shoe press apparatus, the belt comprises a base member b, and high molecular weight elastic members e, which are provided on both sides of the base member b. The base member b is provided to impart strength to the elastic belt B as a whole. A woven fabric, having a warp and weft, is typically used as the base member.

The high molecular weight elastic members e, which form both the felt contacting surface and the shoe contacting surface of the elastic belt, are composed of a resin having a hardness of 70 to 98, such as urethane resin, etc.

Optionally, a plurality of grooves (not shown) may be provided on the felt contacting surface of the belt B, so that water squeezed from the wet paper web W in the press part N may be held in the grooves.

Compressed air is supplied to the inside of the endless elastic belt B to expand it into a cylindrical shape as shown in FIG. 5.

In the press part N, water, which is squeezed from the wet paper web W, moves to the elastic belt B through a felt F as the paper web W is pinched.

Although most of the water which moves onto the elastic belt B is shaken off in the direction of arrow a in FIG. 5 as a result of movement of the belt, part of the water sometimes continues to adhere to the belt, and re-enters the press part. Thus, water adhering to the belt may not be squeezed adequately from the wet paper web W.

To address the problem of re-entry of the adhering water into the press part, a doctor blade has been proposed to remove the water adhering to the roll. The blade may be a metallic doctor blade, or a doctor blade composed of a felt impregnated with rubber or resin as disclosed in Unexamined Japanese Patent Publication No. 20697/1981.

However when these doctor blades applied to an elastic belt such as belt B, the result is not entirely satisfactory. For example, although a metallic doctor blade is highly effective in removing water from an elastic belt, it causes the elastic belt to wear out rapidly. Moreover, when the elastic belt is expanded by compressed air, it is not necessarily straight in the cross machine direction, and therefore it is difficult to ensure that the metallic doctor blade is in uniform contact with the elastic belt. There is also a risk of damage to the elastic belt caused by digging of the tip of the metallic doctor blade into to the elastic belt.

In the case of a doctor blade composed of a felt impregnated with rubber, resin, or the like, it is necessary to minimize the amount of impregnated material in order to improve adhesion to the elastic belt B. However, lessening of the amount of impregnated material impairs the shape retention of the doctor blade, allowing it to deform in use, with the result that its water removal capability deteriorates.

BRIEF SUMMARY OF THE INVENTION

This invention addresses the above problems by providing a doctor blade for removing water, comprising a fibrous laminate impregnated with resin. The fibrous laminate comprises plural fibrous layers, at least a portion of one of which is capable of contacting a mating member, such as a belt, for removal of water from the mating member. The concentration of resin impregnated into said one of the fibrous layers is less than the concentration of resin impregnated into the remainder of the fibrous layers of the laminate.

Preferably the fibrous laminate includes at least one base material layer and plural fibrous layers. In a preferred embodiment, the fibers of at least a portion of said one of said fibrous layers, are thinner than the fibers of the remainder of the fibrous layers of the laminate.

In the doctor blade according to the invention, the degree of freedom of the fibers of the layer which are in contact with the mating member is increased, and uniform contact with the mating member is promoted by making the amount of resin impregnated into the layer which contacts the mating member less than the amount of resin impregnated into other layers which are not in contact with the mating member. The more uniform contact between the blade and the mating member improves the water removal capability of the blade, enhances its durability by increasing the amount of resin impregnated into the layers which are not in contact with the mating member, enhances its rigidity, and improves its shape retention characteristics. The invention also decreases abrasion of the mating member with which the doctor blade is in contact.

BRIEF DESCRIPTION OF DRAWINGS

FIG. 4 is a table showing the results of water removal capability, abrasion, and shape retention tests on three examples of doctor blades in accordance with the invention, and also on two comparative examples and a conventional example;

DETAILED DESCRIPTION OF THE PREFERRED EMBODIMENTS

Figure 1A:
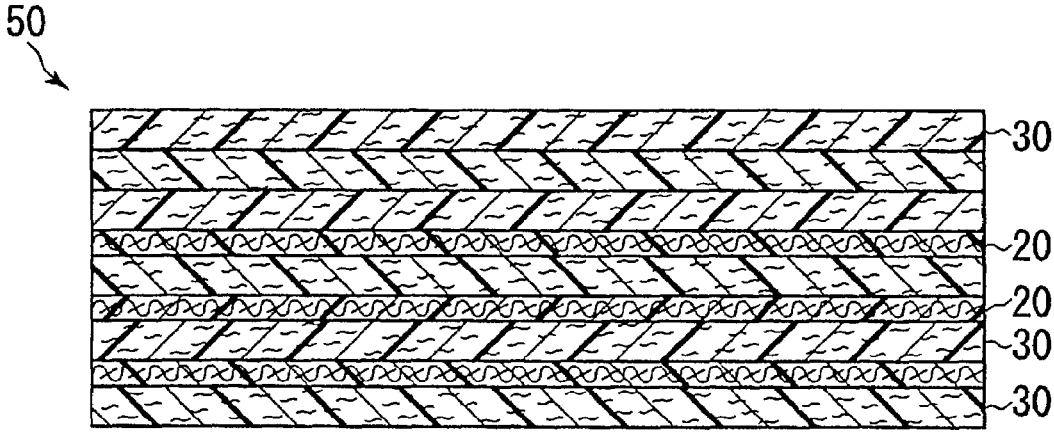
FIG. 1A is a cross-sectional view of a portion of a doctor blade according to the invention.

As shown in FIG. 1A, the doctor blade 10 according to the invention is a fibrous laminate 50, composed of base material layers 20, and fibrous batt layers 30 impregnated with resin.

Although each base material layer 20 is usually a woven fabric, or yarn layer, etc., composed of universal fibers, a film, or spun bond or molded resin or the like, may be used. In the batt fiber layer 30 yarns of general-purpose fiber are stratified. In the laminate 50, a plurality of base material layers 20 and a plurality of fibrous layers 30 are laminated and integrated. However, there are also cases in which base material layers are not used, and the laminate is composed only of fibrous layers.

In the laminate 50, a plurality of base material layers 20 and a plurality of fibrous layers 30 may be laminated and intertwiningly integrated by needle punching all at the same time. Alternatively, separate units composed of base material layers 20 and fibrous layers 30 may be integrated by needle punching, and thereafter laminated and integrated with other similar units by needle punching.

Though a universal fiber such as polyamide fiber, polyester fiber, and the like may be used as a base material 20 and fibrous layer 30, it is desirable to use aromatic polyamide fiber and the like when a heat resistance is required.

The base material layers 20 and the fibrous layers 30 may be glued together by a resin or the like. However, integration by needle punching has the advantage that it suppresses peeling of the layers from one another.

A thermoplastic binder may be added into the fibrous layers 30, for example by sprinkling it into the heat-meltable fibers when mixing them, or by sprinkling it into the fibrous layers when integrating them with the base layers by needling. As a further alternative, the thermoplastic binder may be added, for example by sprinkling, to the fibrous layers 30 after integration of the layers by needle punching and heating, but before impregnating them with resin solution. The use of the binder will cause the fibers to stick together and prevent loss of fibers from the blade while in use.

After the laminate 50 is impregnated with the resin solution, the resin is hardened by the application of heat, and cut. If desired, the edge of the doctor blade may be tapered by machining. Doctor blades 10*b* and 10*c* having the shapes shown in FIGS. 1B and 1C may be obtained.

An additive, for example a hardener, or a thickener such as methyl cellulose, etc., is mixed or scattered into thermoplastic resin and/or a thermosetting resin such as butadiene-styrene rubber (synthetic rubber produced by styrene-butadiene copolymerization), polyurethane, acrylic resin, epoxy resin, or phenolic resin, to produce a resin solution. An adjustment is preferably carried out so that the void content of the doctor blade after hardening and impregnating is between 50% and 80%.

It is possible to control the permeation of the resin into the laminate 50 by increasing or decreasing the quantity of thickener mixed into the resin solution.

Figure 1B:
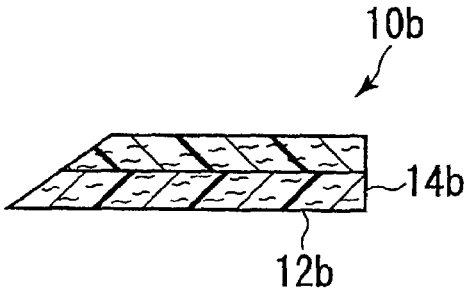
FIGS. 1B and 1C are enlarged partial cross-sectional views showing doctor blade of different shapes.
Figure 1C:
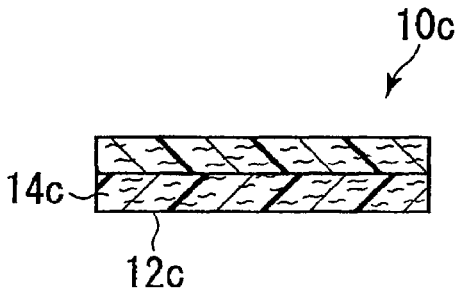

Afterwards, heating is carried out, and the resin is cured and cut to form the doctor blade of FIG. 1B or FIG. 1C. If desired, a taper as shown in FIG. 1C is formed by machining.

If resin is impregnated into one side of the laminate 50, the concentration of the resin, i.e. the amount contained in a given small volume of the laminate, varies in the direction of blade thickness as shown in FIGS. 1B and 1C. That is, in the doctor blades 10*b* and 10*c* according to the invention, the concentration of impregnated resin is greater on the side at which resin is impregnated into the laminate, and less at the other side (side 12*b* in FIG. 1B and side 12*c* in FIG. 1C). Each of the doctor blades 10*b* and 10*c* of FIGS. 1B and 1C comprises two layers which contain different concentrations of impregnated resin. Alternatively, however, the concentration of impregnated resin may vary gradually across the thickness of the laminate in the direction of thickness, and the resin may not reach the other side. In doctor blades 10*b* and 10*c*, the elastic belt contacting layers 14*b* and 14*c*, which are immediately inside the sides 12*b* and 12*c*, contain comparatively little impregnated resin. In the case of a tapered doctor blade as shown in FIG. 1B, either the lower side or the upper side may serve as the elastic belt-contacting side having a relatively low resin content compared to that of the other side.

In selecting the resin wear resistance and hydrolysis resistance, etc. should be considered. Either a single resin, or a mixture or different kinds of resin, may be used.

To impregnate a laminate 50 with resin, granular resin may be impregnated into the surface of the laminate and heated and pressurized by a press. The same resins as mentioned above may be used in this case. However, it is necessary to consider wear resistance and flexibility in either case.

The void content of doctor blade 10 may be adjusted by controlling the density of the laminate 50, or the amount of impregnated resin. Void content may also be adjusted by adding a foaming agent to the resin solution or granular resin.

Moreover, when a lubricating additive such as molybdenum disulfide is added to the solution or fine resin particles, friction drag of the doctor blade against an elastic belt can be decreased.

In the laminate of the doctor blades 10*b*, and 10*c*, the fibers which compose the layer which contacts the mating elastic belt, are preferably thinner than the fibers composing the layers which do not contact the elastic belt. When the contacting layer is composed of these thinner fibers, adhesion of the doctor blade to the elastic belt increases.

Figure 2A:
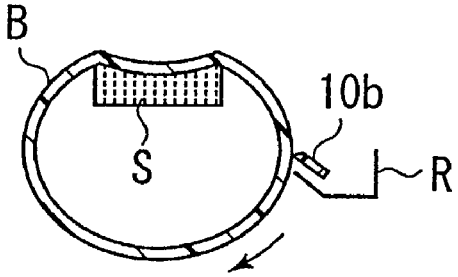
FIG. 2A is a schematic view showing a doctor blade of FIG. 1B in a shoe press apparatus, where only a tip of the doctor blade is pressed against an elastic belt.
Figure 2B:
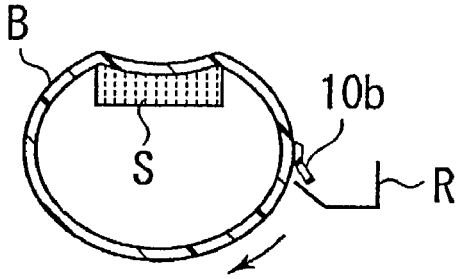
FIG. 2B is a schematic view showing the doctor blade of FIG. 1B pressed against an elastic belt.

FIGS. 2A and 2B show a doctor blade 10*b* according to the invention used in a shoe press apparatus. The doctor blade may be used either with its tip in contact with an elastic belt B as shown in FIG. 2A, or in a deflected condition, as shown in FIG. 2B, where a portion of a surface of the blade is in contact with the elastic belt B so that the area of the blade which is in contact with the belt B is broadened. However, in either case, elastic belt contact layers 14*b* or 14*c* are in contact with the elastic belt B.

As shown in FIGS. 2A and 2B, water removed by the doctor blade 10*b* flows into a water receiver R.

Examples of doctor blades according to the invention were made and tested, as explained below with reference to FIG. 4.

In Examples 1–3, the base material was a woven fabric of plain weave made from polyester (PET) spun yarn (basis weight 100 g/m$^2$), used as both warp and weft. Polyester fiber (17dtex) was used to produce the batt fiber layers.

The base material was integrated with the polyester batt fiber layers by needling, fibrous layers being provided on both sides of each layer of base material to form an integrated unit. The amount of the polyester fiber in each layer was 120 g/m$^2$.

Three such integrated units were piled up and integrated by needling. Moreover, polyester fiber (120 g/m$^2$) was integrated with the integrated units by needling, and a laminate having a basis weight of 3500 g/m$^2$, a thickness of 10 mm as a whole, and a density of 0.35 g/cm$^3$ was obtained.

Styrene butadiene latex (SBL) and a hardener were then mixed, a thickener was added to the solution, which was diluted with water. The diluted resin solution was spread onto one side of each laminate In the doctor blades of Examples 1–3 according to the invention, the impregnation depth of the resin solution into the laminate, measured from one side of the laminate in the thickness direction, varied. Thus the resin solution was impregnated into the laminate to the depth of 7 mm in Example 1, 5 mm in Example 2, and 3 mm in Example 3. Afterwards, the resin was dried and hardened, the laminates were cut in the direction of the needles, and the taper machining was carried out to produce the blade configuration shown in FIG. 1(*b*). Doctor blades were obtained, in which the amount of impregnated resin (given by the ratio of weight of the solid resin to the weight of the laminate) was 20%, and the void content was 67.6%.

The doctor blades of Comparative example 1 and 2 were made by impregnating resin uniformly throughout the thickness of laminates having the above-described structure. The void content was 72.9% in Comparative example 1 and 67.6% in Comparative example 2, and the amount of impregnated resin was 5% in Comparative example 1 and 20% in Comparative example 2.

In addition, a doctor blade as disclosed in Unexamined Japanese Patent Publication No. 20697/1981 was made as a Conventional example. In the Conventional example, the resin was impregnated uniformly throughout the thickness of the laminate. The void content was 43.6%, and the amount of impregnated resin was 30%.

Figure 3:
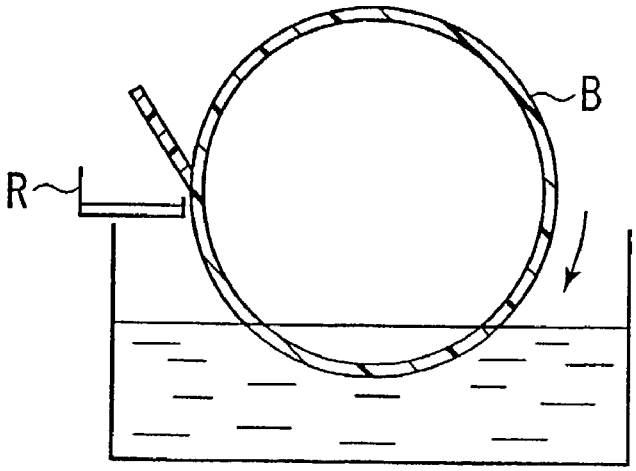
FIG. 3 is a schematic view of an apparatus for conducting water removal capability, abrasion, and shape retention tests on doctor blades.
Figure 5:
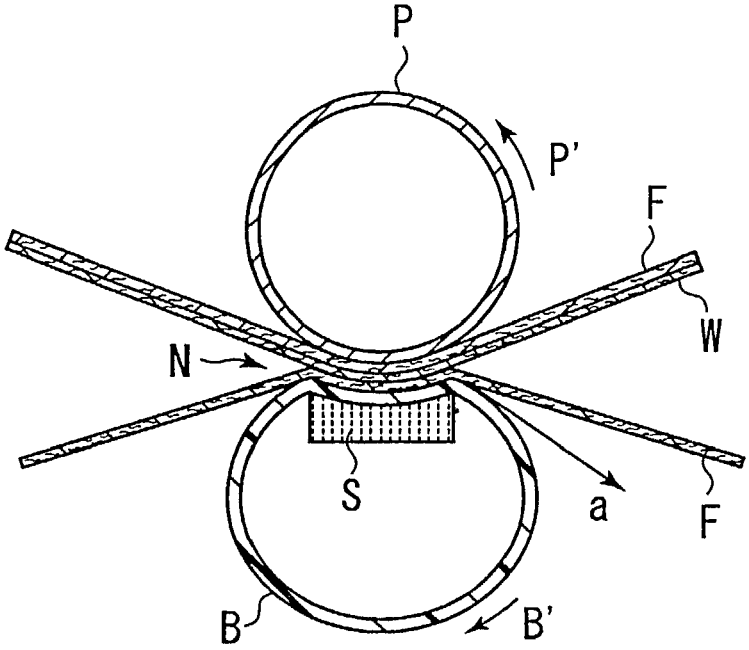
FIG.5 PRIOR ART
FIG. 5 is a schematic view of a shoe press apparatus used in the press part of a papermaking machine.
Figure 6:
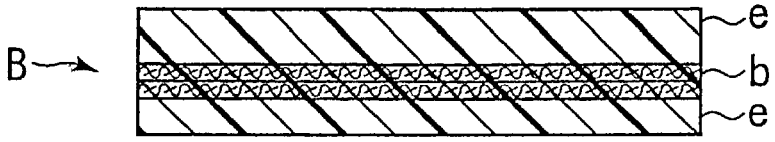
FIG.6 PRIOR ART
FIG. 6 is an enlarged cross-sectional view of an elastic belt used in a shoe press apparatus.

Water removal capability tests, abrasion tests and shape retention characteristic tests of these doctor blades were conducted using the apparatus shown in FIG. 3. This apparatus measured the amount of removed water and the abrasion loss of the belt B, by rotating the endless belt B in the direction of the arrow of FIG. 3 with part of the belt B soaked in water, and with the doctor blade in contact with the belt.

A belt made of polyurethane having a plurality of surface grooves, each 1 mm in width and 1 mm in depth, and spaced at intervals of 3 mm between grooves, was used as the belt B.

After the belt B was rotated in the testing at 60 rpm for five minutes, the amount of water removed by the doctor blade, that is, the amount of water in water receiver R, was measured to determine the water removal capability of the doctor blade.

After the belt B was rotated in the same apparatus at 100 rpm for 1000 hours, the abrasion loss of the belt B was measured, and the change of the shape of the doctor blade was also evaluated.

The test results are shown in FIG. 4. The results of the water removal capability test and the abrasion test are shown by ratio in FIG. 4. A large value in the results of the water removal capability test means a high water removal capability. Similarly, a large value in the results of the abrasion test indicates a high abrasion suppression capability.

The space occupational rate of the fiber part in the figure is the product of the density of the fiber part and the specific gravity of fibers multiplied by 100. The space occupational rate of the resin is the product of the density of the fiber part and the amount of impregnated resin multiplied by the specific gravity of resin.

As shown in FIG. 4, the doctor blades of Examples 1–3 according to the invention exhibited excellent water removal capability, abrasion performance, and shape retention. On the other hand, although Comparative example 1 had good water removal capability and abrasion performance, it was inferior in shape retention. Moreover, although Comparative example 2 and the Conventional example exhibited good shape retention they were inferior in water removal capability and the abrasion performance.

The member mating with the doctor blade according to the invention is typically the elastic belt of a shoe press apparatus as explained above in detail. However, the mating member, from which water is removed by the doctor blade of the invention, is not necessarily limited to the elastic belt of a shoe press apparatus.

As explained above, the doctor blade according to the invention is capable of adapting itself to the mating member easily, and exhibits enhance adhesion to the mating member since the amount of resin in the layer which is in contact with the mating member is reduced. The doctor blade also has excellent shape retention characteristics and improved water removal capability, since a greater amount of resin is present in the layers which are not in contact with the mating member.

Moreover, since the amount of resin in the layer which is in contact with the mating member is low, the doctor blade causes little abrasion loss or other damage to the mating member.

What is claimed is:

1. A doctor blade for removing water from a mating member, said doctor blade comprising a fibrous laminate impregnated with resin, said laminate having opposite first and second sides, and a portion of said first side being capable of contacting said mating member for removal of water from said mating member, wherein the concentration of impregnated resin within a portion of the fibrous laminate from said first side, capable of contacting said mating member, to an intermediate location between said first and second sides is less than the concentration of impregnated resin in the portion of the fibrous laminate extending from said intermediate location to said second side.

2. A doctor blade as claimed in claim 1, wherein the fibers within the portion of said fibrous laminate from said first side to said intermediate location are thinner than the fibers within the portion of the laminate between said intermediate location and said second side.

3. A doctor blade as claimed in claim 1, wherein said fibrous laminate includes at least one base material layer and plural fibrous layers.

4. A doctor blade as claimed in claim 3, wherein the fibers within the portion of said fibrous laminate from said first side to said intermediate location are thinner than the fibers within the portion of the laminate between said intermediate location and said second side.

* * * * *